US007883265B2

(12) United States Patent
Kotler et al.

(10) Patent No.: US 7,883,265 B2
(45) Date of Patent: Feb. 8, 2011

(54) DEVICES, SYSTEMS, AND METHODS FOR PREPARING EMULSIONS

(75) Inventors: Lev Kotler, Allston, MA (US); John Andrew Sheridan, Marblehead, MA (US); Gina Costa, Essex, MA (US); Joseph Podhasky, San Rafael, CA (US)

(73) Assignee: Applied Biosystems, LLC, Carlsbad, CA (US)

( * ) Notice: Subject to any disclaimer, the term of this patent is extended or adjusted under 35 U.S.C. 154(b) by 426 days.

(21) Appl. No.: 12/130,502

(22) Filed: May 30, 2008

(65) Prior Publication Data

US 2009/0035825 A1 Feb. 5, 2009

Related U.S. Application Data

(60) Provisional application No. 60/941,505, filed on Jun. 1, 2007.

(51) Int. Cl.
*B01F 11/00* (2006.01)
*B67D 7/74* (2010.01)

(52) U.S. Cl. ..... 366/208

(58) Field of Classification Search ..... 366/208
See application file for complete search history.

(56) References Cited

U.S. PATENT DOCUMENTS 3,159,384 A * 12/1964 Davis ..... 366/110
3,219,318 A 11/1965 Hershler
3,220,704 A 11/1965 Phillips
3,926,809 A 12/1975 Jones
3,975,001 A 8/1976 Moore et al.
3,985,649 A 10/1976 Eddelman
4,042,218 A 8/1977 Moore et al.
4,079,009 A 3/1978 Seiler
4,555,183 A * 11/1985 Thomas ..... 366/208
4,737,467 A 4/1988 Rice
4,777,906 A 10/1988 Mourning et al.
4,845,025 A 7/1989 Lary et al.
4,848,917 A 7/1989 Benin et al.
5,186,827 A 2/1993 Liberti et al.
5,195,825 A 3/1993 Ringrose
5,215,376 A 6/1993 Schulte et al.
5,378,360 A 1/1995 Huse
5,458,785 A 10/1995 Howe et al.
5,466,574 A 11/1995 Liberti et al.
5,496,473 A 3/1996 Chow
5,597,530 A 1/1997 Smith et al.
5,702,950 A 12/1997 Tajima
5,705,062 A 1/1998 Knobel
5,813,759 A * 9/1998 Gebrian ..... 366/208

(Continued)

FOREIGN PATENT DOCUMENTS

WO WO 2005/073410 A2 8/2005

OTHER PUBLICATIONS

Brochure entitled "Introducing The Polonator G.007," from Danaher Motion-Dover.

*Primary Examiner*—Christina Johnson
*Assistant Examiner*—Robert Warden

(57) ABSTRACT

A vortex mixer and method for forming an emulsion wherein the mixer is adapted to form an emulsion with a desired droplet size and having a desired volume. The vortex mixer provides improved uniformity in emulsion preparation and may be used to create multiple emulsions simultaneously.

49 Claims, 5 Drawing Sheets

U.S. PATENT DOCUMENTS 5,830,663 A 11/1998 Embleton et al.
5,834,197 A 11/1998 Parton
5,897,783 A 4/1999 Howe et al.
5,976,369 A 11/1999 Howe et al.
6,033,574 A 3/2000 Siddiqi
6,159,271 A 12/2000 Tillotson et al.
6,165,778 A * 12/2000 Kedar ..... 506/33
6,187,270 B1 2/2001 Schmitt et al.
6,228,268 B1 5/2001 Siddiqi
6,231,760 B1 5/2001 Siddiqi
6,231,814 B1 5/2001 Tajima
6,324,207 B1 11/2001 Kanterakis et al.
6,331,277 B2 12/2001 Tajima
6,332,705 B1 12/2001 Herz et al.
6,402,367 B1 6/2002 Lu et al.
6,455,316 B1 9/2002 Turner et al.
6,482,363 B1 11/2002 Dobelin
6,485,692 B1 11/2002 Freitag et al.
6,489,103 B1 12/2002 Griffiths et al.
6,494,611 B2 12/2002 Edwards et al.
6,500,343 B2 12/2002 Siddiqi
6,509,193 B1 1/2003 Tajima
6,618,948 B2 9/2003 Lin
6,626,912 B2 9/2003 Speitling
6,637,927 B2 10/2003 Lu et al.
6,673,316 B1 1/2004 Okamoto et al.
6,709,148 B2 3/2004 Glass
6,726,650 B2 4/2004 Schneider et al.
6,764,859 B1 7/2004 Kreuwel et al.
6,802,642 B2 10/2004 Fallenius
6,827,478 B2 12/2004 Becker et al.
6,884,357 B2 4/2005 Siddiqi
7,029,164 B2 4/2006 Linsen et al.
7,105,357 B1 9/2006 Kalkum et al.
7,138,233 B2 11/2006 Griffiths et al.
2003/0003021 A1 1/2003 McGrath et al.
2003/0195489 A1 10/2003 Peterson
2004/0186425 A1 9/2004 Schneider et al.
2004/0253731 A1 12/2004 Holliger et al.
2005/0013741 A1 1/2005 a'Brassard
2005/0037392 A1 2/2005 Griffiths et al.
2005/0042648 A1 2/2005 Griffiths et al.
2005/0064460 A1 3/2005 Holliger et al.
2005/0074360 A1 4/2005 DeWalch
2005/0079510 A1 4/2005 Berka et al.
2005/0213427 A1 9/2005 Steckle et al.
2006/0058511 A1 3/2006 Tanikawa et al.
2006/0201887 A1 9/2006 Siddiqi
2006/0207944 A1 9/2006 Siddiqi
2007/0047385 A1 3/2007 Girvin et al.
2007/0087362 A1 4/2007 Church et al.
2008/0247914 A1 * 10/2008 Edens et al. ..... 422/100

* cited by examiner

FIG. 3
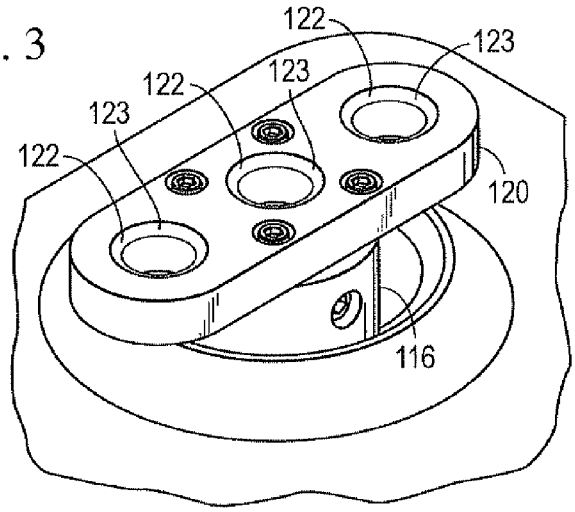
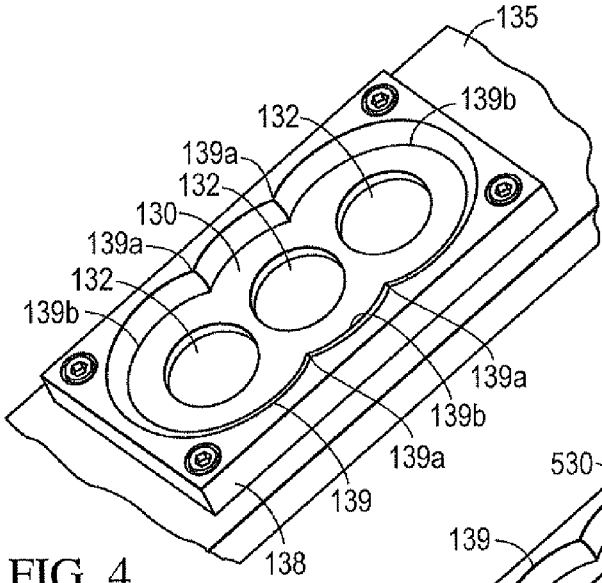
FIG. 4
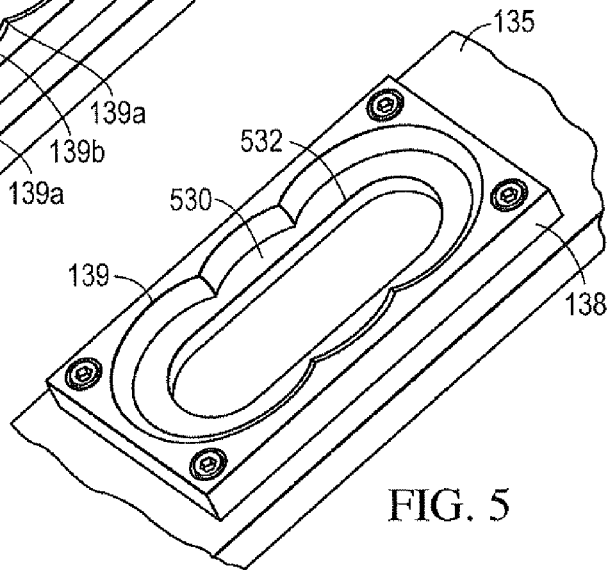
FIG. 5

DEVICES, SYSTEMS, AND METHODS FOR PREPARING EMULSIONS

CROSS REFERENCE TO RELATED APPLICATIONS

This application claims a priority benefit under 35 U.S.C. §119(e) to U.S. Provisional Application No. 60/941,505, filed Jun. 1, 2007, the contents of which are incorporated herein by reference.

FIELD

The present invention relates to devices, systems, and methods for preparing emulsions, including emulsions useful in biological reaction processes, such as, for example, amplification processes.

INTRODUCTION

A number of biological sample analysis methods rely on sample preparation steps as a precursor to carrying out the analysis methods. For example, a precursor to performing many biological sequencing techniques (e.g., sequencing of nucleic acid) includes amplification of nucleic acid templates in order to obtain a large number of copies (e.g., millions of copies) of the same template.

One amplification method includes encapsulating a plurality of biological samples (e.g., nucleic acid samples) individually in a microcapsule of an emulsion and performing amplification on each of the plurality of encapsulated nucleic acid samples simultaneously. Such microcapsules are often referred to as "microreactors" since the amplification reaction occurs within the microcapsule.

In some cases, the microcapsule is a capture bead and the amplification process is referred to as bead emulsion amplification. In such a technique, beads containing DNA templates are suspended in an aqueous reaction mixture and then encapsulated in a water-in-oil emulsion. The template DNA may be either bound to the bead prior to emulsification or may be included in solution in the amplification reaction mixture. For further details regarding techniques for bead emulsion amplification, reference is made to PCT publication WO 2005/073410 A2, entitled "NUCLEIC ACID AMPLIFICATION WITH CONTINUOUS FLOW EMULSION," which published internationally on Aug. 11, 2005, and is incorporated by reference in its entirety herein.

Performing bead emulsion amplification requires the formation of an emulsion containing the beads encapsulating the template DNA and a reagent mixture for supporting the amplification reaction. As noted above, the emulsion typically comprises a water-in-oil emulsion with the aqueous phase (e.g., dispersed phase) including the reagent mixture and the beads, and the continuous phase including oil.

Various emulsion preparation techniques have been used. For example, WO 2005/073410 A2, incorporated by reference herein, teaches a cross-flow emulsification system in which emulsion oil is pumped into one of a plurality of tees having a tapered area that is in flow communication with a syringe configured to inject a plurality of microreactors into the emulsion oil to form the emulsion. This system may generate droplets of 80 to 120 μm with the dispense channel diameter of 120 μm. Therefore, the droplet size is generally comparable to the dispense channel size. Using such a system one may encounter difficulties in employing the described cross-flow system to generate smaller droplets for example below 10 um (including in the range of 4 to 9 μm) in diameter. Considerations in this regard is that manufacture of tees with channels smaller than 10 μm may be expensive and the emulsification may take an long time due to a generally low flow rate that can be achieved through the such dispense channel. In addition, the process may require application of high pressure to push the PCR mixture with the beads through the narrow opening, and may in turn limit the choice of materials capable to withstand the applied pressure. As a simplified example, to achieve the same flow rate though the opening of 6 μm as through 120 μm, having the channel length the same, one might be required to increase pressure substantially 400-fold or more. Such systems may also be prone to clogging and beads sedimentation.

An emulsification system based on agitation of the continuous phase may address some of the aforementioned issues and allow for various methods of the dispersed phase addition. One technique (Dressman et al, PNAS, Jul. 22, 2003, vol. 100, no. 15, 8817-8822) describes a technique for emulsion preparation using a magnetic stirrer and a magnet bar agitating the continuous oil phase while aqueous phase (PCR mixture with beads) is being added dropwise to it using a manual pipettor. A drawback of this system is a necessity to agitate an open tube with the emulsion, which makes it prone to splashing of oil and emulsion, leading to sample losses and possible contamination of the stirrer, pipettor and the bench with DNA. Furthermore, addition of the aqueous phase is done manually, which can be tedious and can result in poor uniformity and reproducibility of the emulsion due to inconsistency of the droplet size and position of the pipet tip during dispense. Finally, in this system, magnetic beads may become oriented in the strong magnetic field of the stirrer, thus resulting in a non-random beads distribution in the emulsion.

Another technique involves pipetting controlled amounts of the dispersed aqueous phase (including the microreactors which may be in the form of beads) into a test tube containing oil and then placing the test tube on a vortex mixer to form the emulsion. This technique, however, may be relatively time-consuming since the emulsion formation may require iterative steps of adding the dispersed phase followed by vortexing until the desired emulsion is obtained. Moreover, typically the test tube in which the emulsion is formed is moved between a location at which the dispersed aqueous phase is pipetted or otherwise added into the continuous phase in the test tube and a location at which the vortexing occurs. During the vortexing step, a user often places a bottom, closed end of the test tube onto a mounting piece of the vortex mixer, while holding an upper portion of the test tube as the vortex mixer imparts motion to the test tube.

In another method of emulsification, a more complex approach was taken (Diehl et al., PNAS, Nov. 8, 2005, vol. 102, no. 45, 16368-16373). Initially, both aqueous and oil phases were mixed together (no dispensing) and briefly vortexed followed by quick emulsification using an overhead homogenizer. This process involves multiple steps and at least two transfers of emulsion from one vessel into another, which can lead to sample losses. Furthermore, there is also a concern that existing disposable emulsion generators may not be effective in making uniform emulsions with the optimum droplet size on the scale larger than 1 ml.

Thus, conventional emulsion preparation techniques relying on vortexing may be relatively time-consuming. In addition, such conventional techniques are relatively user-intensive, requiring the user to perform iterative pipetting, or other dispersion phase adding steps and vortexing steps and/or to hold the test tube in position as it is being vortexed. Further, the iterative process of the dispersion phase adding steps and the vortexing steps may be labor intensive under conventional methods since the user typically removes the test tube from the vortex mixer during the dispersion phase adding step. Using magnetic forces to agitate the emulsion may be detrimental to the emulsion quality. Overhead homogenizers with disposable generators require multiple transfers of the emulsion and may not be suitable for making emulsions on the scale larger than 1 ml.

It may be desirable to provide a more automated emulsion preparation technique, for example, one that reduces the activity required by a user during formation of the emulsion. It also may be desirable to provide an emulsion preparation technique that facilitates increasing the throughput of biological sample analysis processes by increasing the efficiency of sample preparation.

Moreover, it may be desirable to provide an emulsion preparation technique that yields substantially consistent bead emulsions, for example, emulsions containing no more than 1 bead per aqueous droplet. It may also be desirable to provide a vortexing technique that yields substantially consistent vortexing rates. In other words, it may be desirable to provide a technique that achieves constant velocity vortexing irrespective of factors such as the amount of solution in a tube that is being vortexed and/or the amount of force on the tube during vortexing, such as, for example, a force on the tube due to supporting the tube during vortexing.

SUMMARY

The present invention may satisfy one or more of the above-mentioned desirable features. Other features may become apparent from the description which follows.

In accordance with the invention and in one embodiment the apparatus may comprise a vortex mixer further comprising: at least one base plate defining at least one first opening configured to receive a first closed end portion of at least one mixing tube and to permit the at least one mixing tube to pivot about the first closed end thereof; at least one motor configured to impart a substantially orbital movement to the base plate; and at least one support member disposed at a distance from the at least one base plate, the at least one support member being configured to receive a second end portion of the at least one mixing tube and to permit the at least one mixing tube to substantially freely pivot about the first closed end portion during orbital movement of the at least one base plate.

In another embodiment, a system is described for forming an emulsion, the system comprising: a mixing tube defining a reservoir configured to contain a continuous emulsion phase, the mixing tube defining an open end portion; a cap configured to engage with the open end portion of the mixing tube; and a dispensing tube having a first end positioned within the reservoir and a second end configured to be placed in flow communication with a supply of an aqueous phase, the dispensing tube being configured to flow the aqueous phase from the supply to the reservoir.

In still another embodiment, a method is described for forming a bead emulsion for amplifying nucleic acid, the method comprising: supplying a mixing tube with a continuous emulsion phase; imparting motion to the mixing tube via a vortex mixer so as to form vortexes in the continuous emulsion phase; and dispensing an aqueous phase comprising beads containing nucleic acid into the mixing tube while imparting the motion to the mixing tube.

These and other features of the present teachings are set forth herein. In the following description, certain aspects and embodiments will become evident. It should be understood that the invention, in its broadest sense, could be practiced without having one or more features of these aspects and embodiments. It should be understood that these aspects and embodiments are merely exemplary and explanatory and are not restrictive of the invention.

BRIEF DESCRIPTION OF THE DRAWINGS

The accompanying drawings, which are incorporated in and constitute a part of this specification, illustrate exemplary embodiments and together with the description, serve to explain various principles. The skilled artisan will understand that the drawings, described below, are for illustration purposes only. The drawings are not intended to limit the scope of the present teachings in any way. In the drawings.

FIG. 3 is a perspective view of an exemplary embodiment of a base plate of a vortex mixer according to aspects of the present teachings;

FIG. 4 is a perspective view of an exemplary embodiment of a support member and clamping plate of the vortex mixer of FIG. 1;

FIG. 5 is a perspective view of another exemplary embodiment of a support member and clamping plate;

DESCRIPTION

Reference will now be made in detail to various exemplary embodiments, examples of which are illustrated in the accompanying drawings. Wherever possible, the same reference numbers will be used throughout the drawings to refer to the same or like parts.

Figure 1:
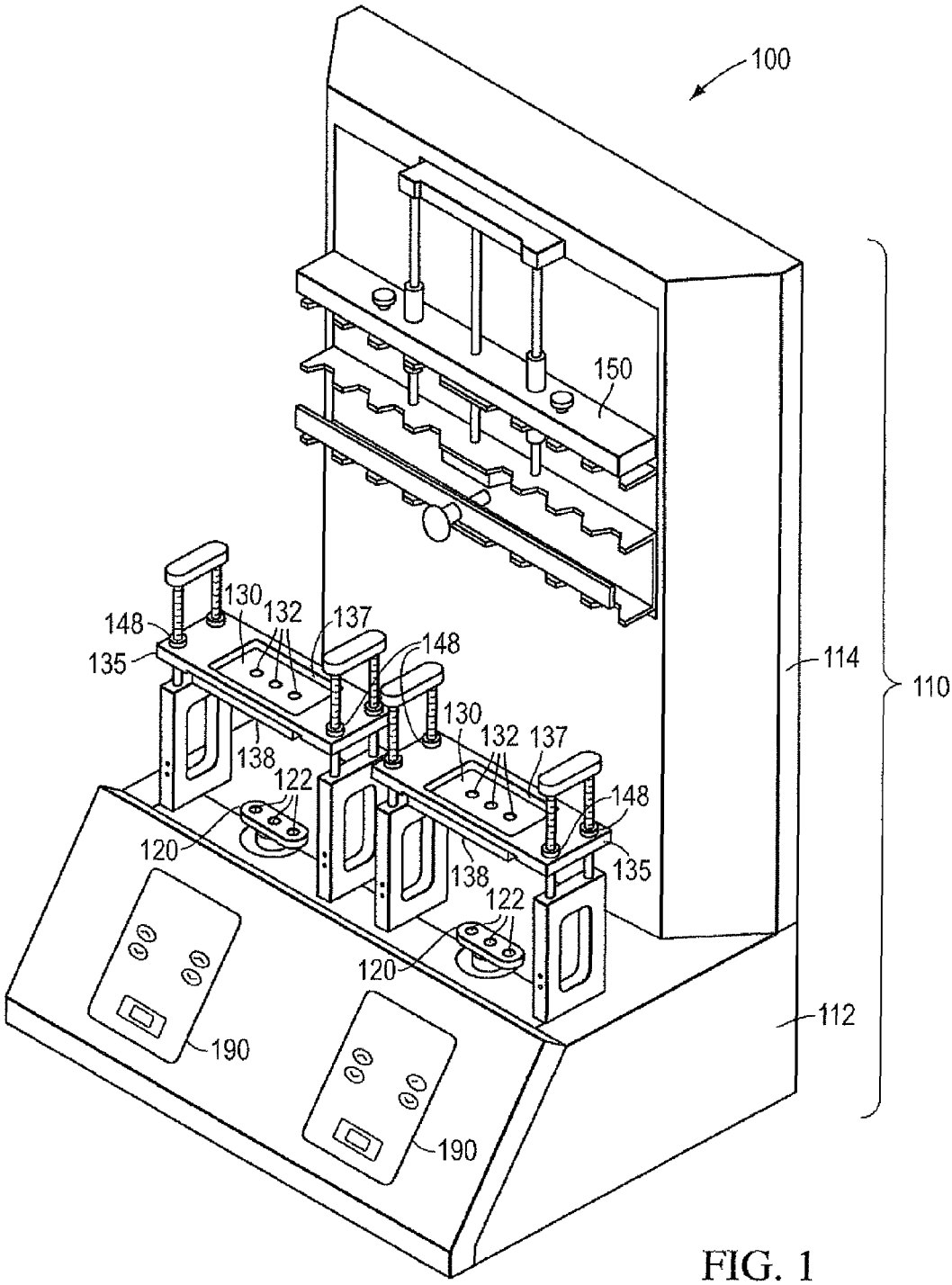
FIG. 1 is a perspective view of an exemplary embodiment of a vortex mixer according to aspects of the present teachings.
Figure 2:
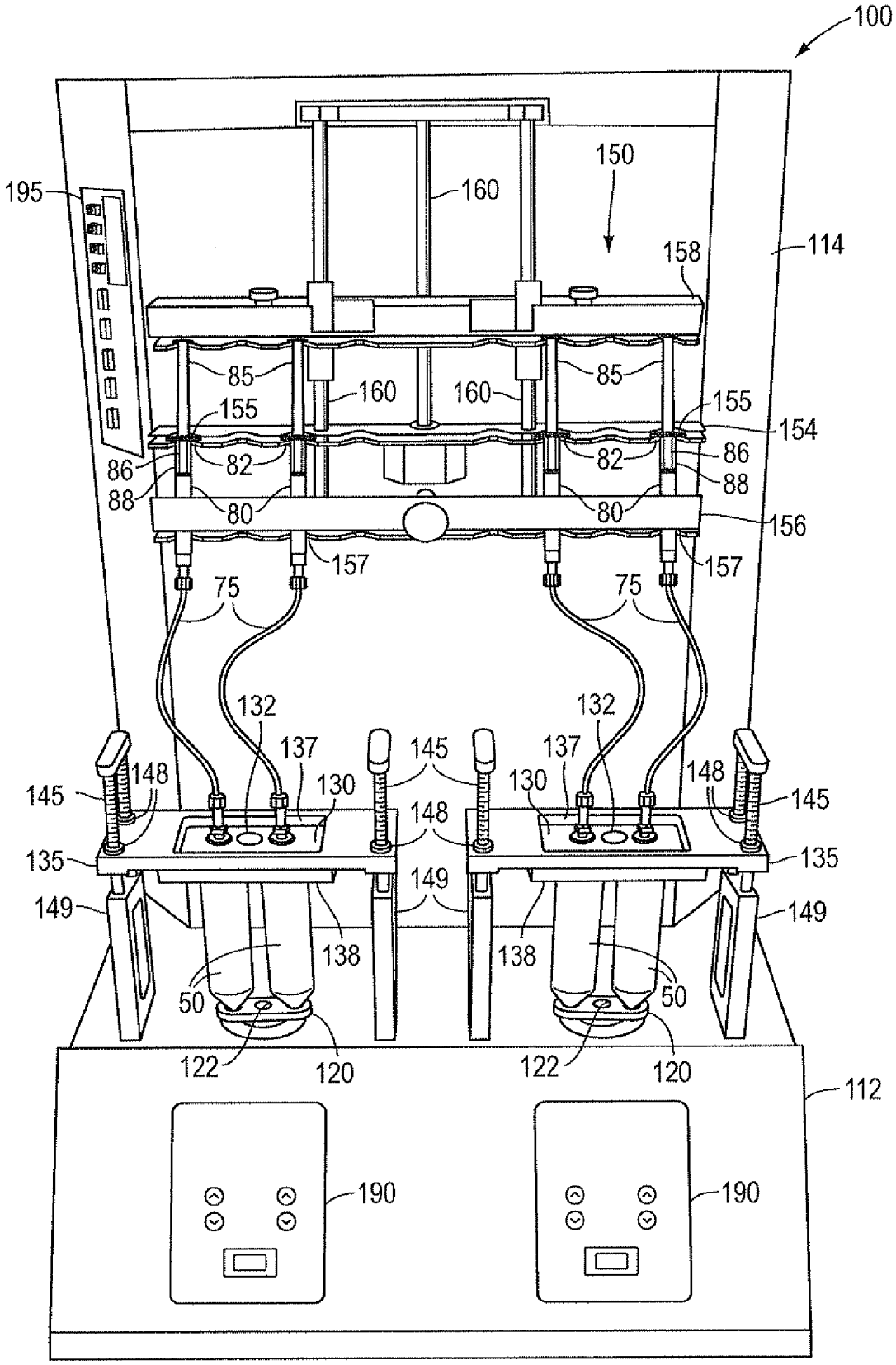
FIG. 2 is a front plan view of the vortex mixer of FIG. 1 holding mixing tubes and syringes according to aspects of the present teachings.

An exemplary embodiment of a vortex mixer 100 in accordance with aspects of the present teachings is illustrated in FIGS. 1 and 2. The vortex mixer 100 comprises a housing 110 that includes a base portion 112 and an upright portion 114. The base portion 112 of the housing 110 may be configured to house two motors (not shown), with each motor corresponding to a respective base plate 120 to impart motion thereto. The motors may be connected to the base plates 120 so as to impart a generally orbital motion. Such connection may be the same connection that is typically used to impart motion to mounting cups and the like in conventional vortex mixers. Those skilled in the art would understand various motor configurations and how those motors may be coupled to base plates 120 to provide a generally orbital motion to the base plates 120.

In various exemplary embodiments, the speed of the motors may be individually controlled by respective control panels 190, which may include both speed increasing/decreasing controls and on/off switches. Further, the motors may be connected to a data bus line or the like (not shown) such that a user may program a speed of operation of the motors, including a speed versus time protocol. A user may input a speed protocol directly into a data input system integrated with the vortex mixer, for example, as part of a control panel 195 or 190 on the vortex mixer 100, or via a remotely located data input system (e.g., computer) configured to be placed in data communication with the vortex mixer 100.

As shown in the close-up, top view in FIG. 3, each base plate 120 (only one of which is depicted in FIG. 3) may be connected to a drive shaft 116 of the respective motor configured to impart motion to the base plate 120. The base plates 120 may be made of plastic or other material that has relatively low friction with a surface of mixing tubes that may be received by the base plates 120. The material of the base plates 120 may be selected to permit relatively free pivotal movement of a mixing tube end portion received by the base plate 120, as will be explained below.

The base plates 120 may define at least one opening 122 in a face of the base plate 120 that faces away from the base portion 112 of the vortex mixer 100. In the exemplary embodiment, three openings 122 are depicted. However, any number of openings may be provided depending on the number of mixing tubes it may be desired to vortex on each base plate 120. The number of openings may be selected based, for example, on the size of each mixing tube to be vortexed using a base plate 120, the power of the motor, and other factors. The openings 122 may extend at least partially or entirely through a thickness of the base plate 120 and have a substantially tapered configuration. More specifically, the openings 122 may taper inwardly in a direction from the face of the base plate 122 that faces upward and away from the base portion 112 toward a face of the base plate 122 that faces downward and toward the base portion 112. The openings 122 also may be provided with a radius 123 at an edge surrounding the opening 122 at the surface of the base plate 120 that faces away from the base portion 112, as illustrated in FIG. 3. The radius 123 may be sufficient to permit a mixing tube received in the respective opening 122 to substantially freely pivot (e.g., rotate) around the opening 122 to permit a substantially orbital movement of the tube.

In various exemplary embodiments, the size of the openings 122 may be configured to be compatible with various tube sizes and configurations. For example, the openings 122 may be configured to accommodate containers/tubes such as microtubes of approximately 1-5 mL, as well as larger containers/tubes of approximately 5-50 mL and even larger container/tubes as appropriate to the desired application. Such flexibility desirably allows smaller or larger volume emulsions to be prepared.

According to various exemplary embodiments, and as illustrated in FIG. 2, the openings 122 may be configured to receive a closed end portion of a mixing tube 50 during vortexing of the mixing tube 50. As mentioned above, the openings 122 may be configured to permit the mixing tubes 50 received therein to substantially freely pivot about the closed end portions of the mixing tubes 50 received in the openings 122. In other words, the relative size and configuration of the openings 122 and of the closed end portion of the mixing tubes 50 may be selected so as to permit the mixing tubes 50 to substantially freely rotate in an approximately orbital path when received by the base plate 120 and vortexed. To achieve the substantially free pivotal movement, the tapered configuration of the openings 122 may correspond to a tapered closed end portion of the mixing tubes 50. By way of nonlimiting example only, the openings 122 may be configured to receive the closed end portions of 50 ml conical mixing tubes. Of course, mixing tubes having other sizes and shapes may also be used. Those skilled in the art would understand how to select a size and configuration, including, for example, a degree of taper, diameter, and radius, of an opening 122 in order to achieve substantially free pivotal movement of a mixing tube received in the opening 122.

With reference again to FIGS. 1 and 2, spaced from the base plates 120 are support brackets 135 that are disposed substantially parallel to the base plates 120. Each of the support brackets 135 may comprise a substantially planar plate that is configured to hold a support member 130. In various exemplary embodiments, the support member 130 is a substantially planar member formed of rubber or other elastic material configured to stabilize a top end portion of a mixing tube 50 during vortexing, as will be described in more detail below. In nonlimiting exemplary embodiments, the support member 130 may be made of rubber and have a thickness of about $\frac{1}{8}^{th}$ inch. As shown in the exemplary embodiment of FIGS. 1 and 2, the support bracket 135 may define an opening 137 and the support member 130 may be coupled to the support plate 135 such that one or more openings 132 provided in the support member 130 are substantially aligned with the opening 137, as illustrated.

In various exemplary embodiments, the support member 130 may define the same number of openings 132 that are defined by the corresponding base plate 120. Each opening 132 may be substantially in alignment with an opening 122, and the openings 132 may be configured to support a top end portion of a mixing tube 50 of which the closed end portion is received in a corresponding opening 122 of a base plate 120, as depicted in FIG. 2 for example. According to various exemplary embodiments, the openings 132 may be configured to permit the passage therethrough of a fitting 68 secured to a cap (not shown in FIGS. 1 and 2) of a mixing tube 50. Further details regarding the fitting 68 and various other elements of the mixing tube 50 are provided below with reference to FIGS. 6 and 7. The openings 132 may thus be configured to provide support to an upper end portion of the mixing tube 50 in a manner that permits the closed end portion of the tube 50 to substantially freely pivot (e.g., rotate about the opening 122) and move in a substantially orbital path, as caused by movement of the base plate 120, thereby forming vortexes in a liquid contained in the mixing tube 50. By providing a support member 130 made of an elastic material, such as, for example, rubber, the support member 130 may be configured to provide a sufficient amount of support to an upper end portion of a mixing tube 50 while still permitting sufficient movement of the upper end portion of the mixing tube 50 such that the free pivotal movement of the closed end portion of the mixing tube 50 is substantially unhindered.

As shown in FIGS. 1 and 2, and in the close up view in FIG. 4, the latter showing a portion of the support plate 135 and the support member 130 from a direction facing the base portion 112 of the vortex mixer 100 (e.g., the bottom of those components in the orientation of FIGS. 1 and 2), a clamping plate 138 defining an opening 139 is positioned on an opposite side of the support member 130 so as to sandwich the support member 130 between the clamping plate 138 and the support bracket 135. The clamping plate 138 may be positioned such that the opening 139 is substantially aligned with the opening 137 and with the openings 132 provided in the support member 130. The clamping plate 138 may be configured to engage with an upper portion of the mixing tube 50 (for example, with a cap provided on the upper portions of the mixing tube) to exert a downward force on the mixing tube 50 during vortexing.

With reference to FIG. 4, the opening 139 may have a substantially elongated shape so as to surround the openings 132 of the support member 130. In addition, the opening 139 may have indented regions 139*a* such that various portions 139*b* of the opening 139 can mate individually with corresponding mixing tubes 50 supported in openings 132 in alignment with those portions 139*b*. In various exemplary embodiments, the portions 139*b* of the opening may be configured to engage with caps, described in more detail below with reference to FIGS. 6 and 7, that close the individual mixing tubes 50.

The clamping plate 138 may be coupled to the support bracket 135 in a manner that sandwiches the support member 135 between the clamping plate 138 and the support bracket 135. In various exemplary embodiments, the clamping plate 138 may be coupled to the support bracket 135 via bolts. However, any suitable coupling mechanisms may be used and are considered within the scope of the invention.

As noted above, the support bracket 135, and thus the clamping plate 138 and support member 130, are configured to move so that a distance between the support bracket 135 and the base plate 120 may be adjusted. In the exemplary embodiment of FIGS. 1 and 2, the support bracket 135 may be provided with openings, for example, at each of its four corners, and may be movable in a substantially vertical direction along threaded posts 145. Adjustable nuts 148 that are configured to engage with the threading on the posts 145 may be provided above and below the support bracket 135 to adjust a position of the support bracket 135 along the threaded posts 145. It should be noted that only the nuts 148 positioned above the support bracket 135 are visible in FIGS. 1 and 2. The posts 145 may be coupled to the base portion of the vortex mixer 100 either directly (not shown) or via side brackets 149 (shown in FIGS. 1 and 2). The use of side brackets 149 to support the posts 145 may improve stability of the support bracket 135 during vortexing by dampening motion due to the motors from transferring from the base portion 112 to the posts 145.

FIG. 5 depicts another exemplary embodiment of a support member 530 that may be used in lieu of the support member 130 described with reference to FIGS. 1, 2 and 4. As with FIG. 4, the view in FIG. 5 is from a direction of the support bracket 135, clamping plate 139, and support member 530 facing the base portion 112 of the vortex mixer 100 (e.g., from the bottom in the orientation of FIGS. 1 and 2). In the exemplary embodiment of FIG. 5, the support member 530 defines a single, substantially elongated opening 532 instead of a plurality of openings 132 of the exemplary embodiment of FIG. 4. The opening 532 may thus have a size sufficient to support the upper end portions of a plurality (e.g., three in the exemplary embodiment of FIG. 5) of mixing tubes simultaneously. By way of the example, the opening 532 of the support member 530 may permit passage therethrough of three respective fittings 68 of three mixing tubes 50, with the clamping plate 139 being configured to engage with the respective caps of the three mixing tubes 50 to provide a downward, clamping force thereon. The opening 532 may have an approximately oval shape, as shown in FIG. 5, or any other suitable size and shape to support a plurality of tubes held by a corresponding base plate to support the tubes while permitting vortexing of the same.

Although the exemplary embodiments of FIGS. 1-5 illustrate base plate/support member pairs that are configured to hold up to three mixing tubes at a time during vortexing, those having skill in the art would understand that the base plate and corresponding support member may be configured so as to support any number of mixing tubes ranging from one to more than three. Moreover, as depicted in FIGS. 1 and 2, during use, each base plate/support member pair (of which there are two in the exemplary embodiment of FIGS. 1 and 2) may hold less than three, for example, one or two, mixing tubes simultaneously during a vortexing operation.

The vortex mixer 100 of FIGS. 1 and 2 also may include a syringe pump 150 supported by the upright portion 114. The syringe pump 150 may have a configuration that is substantially similar to conventional syringe pumps. The syringe pump may further be positioned vertically, permitting an air gap in the syringe to stay at the top of the syringe barrel during dispensing. Further, such a configuration allows substantially all of the aqueous phase to be dispensed in a manner akin to that of a manual pipettor. The syringe pump 150 may thus include an upper syringe support bracket 154 and a lower syringe support bracket 156. Each of the syringe support brackets 154 and 156 may define one or more recesses 155 and 157 respectively, with the upper and lower recesses of each bracket 154 and 156 being substantially aligned with each other. As illustrated in FIG. 2, the upper recesses 155 are configured to engage with the lip 82 of a syringe 80 that is typically grasped by a user's fingers during manual actuation of the syringe 80. More specifically, the surface of the upper bracket 154 may provide a reactive force on the syringe lip 82 that acts against a force on a plunger 85 of the syringe 80 as the plunger 85 is being depressed by the syringe pump 150 to expel substance from the syringe 80. The lower recesses 157 may be configured to receive the hollow body 88 of the syringe 80 to support the syringe 80 in a substantially fixed position during actuation (e.g., depression and/or retraction of the plunger 85).

The syringe pump 150 also includes a movable bracket 158 that is configured to move along rails 160. The movable bracket 158 is configured to engage with the free end of the plunger 85 that remains external from the syringe hollow body 88. The movable bracket 158 is configured to exert a force on the plunger 85 to move the plunger 85 relative to the hollow body 88 in response to and in the same direction as the movable bracket 158 moving along the rails 160, e.g., up and down in FIG. 2.

The syringe pump 150 may be programmable to modulate a rate at which the movable bracket 158 pushes down on the plunger 85. In addition to controlling the rate of motion of the movable bracket 158, the syringe pump 100 may be programmed to move in response to a time-rate protocol. By way of example, a keypad or other data input mechanism 195 may be provided on the vortex mixer 100 to select and/or program a rate and/or rate/time protocol at which the movable bracket 158 moves downward to actuate syringes 80 held in the syringe pump 150. The keypad or other data input mechanism in various alternate exemplary embodiments may be provided via a computer or other data input portal situated remotely from the vortex mixer 100 and connected thereto via a wireless or wired data interface mechanism.

Placing the syringe pump 150 in the orientation depicted in the exemplary embodiment of FIGS. 1 and 2 may minimize air bubbles from getting trapped in the flow tubes 75 that lead from the syringes 80 to the mixing tubes 50. Having the syringes 80 held in the substantially upright and vertical position shown and the flow of the aqueous phase from a syringe 80 into a corresponding mixing tube 50 situated beneath the syringe 80 permits air and/or other trapped gas to naturally rise upwardly away and out of the flow tubes 75 into a top portion of the reservoirs 86 defined by the syringe bodies 88.

Figure 6:
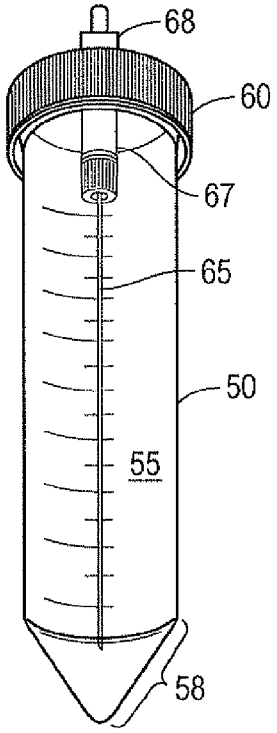
FIG. 6 is a perspective view of an exemplary embodiment of an emulsion preparation system according to aspects of the present teachings.
Figure 7:
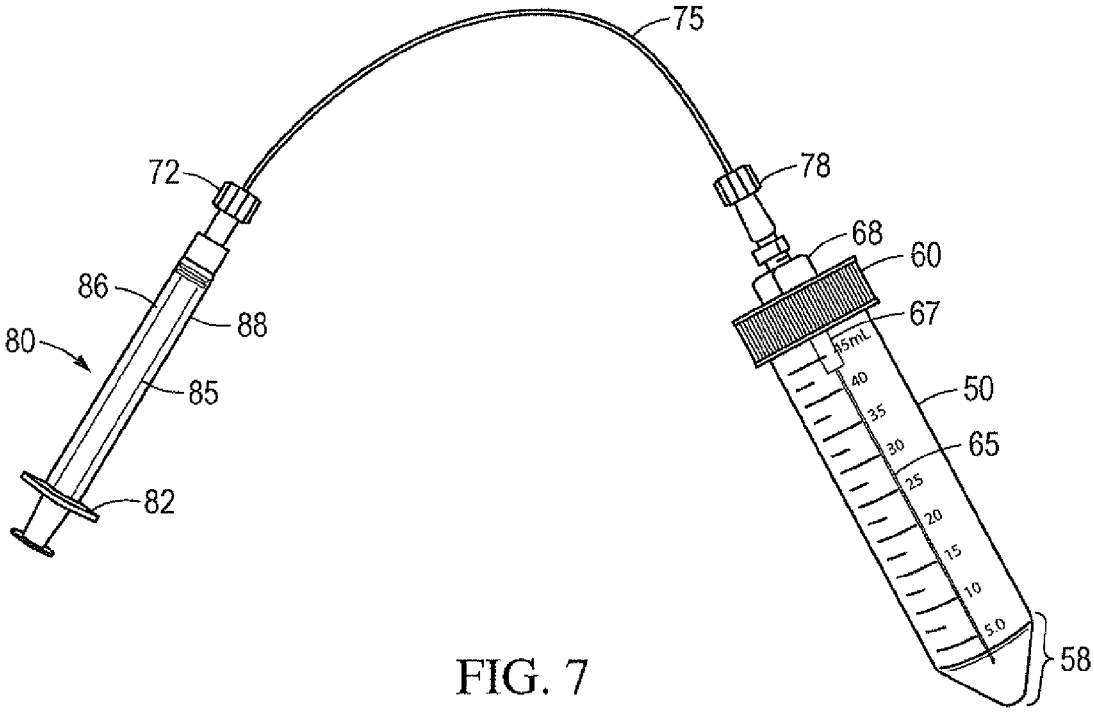
FIG. 7 is a perspective view of the system of FIG. 6 placed in flow communication with a syringe.

FIGS. 6 and 7 show exemplary embodiments of systems that may be useful for forming emulsions in accordance with aspects of the present teachings. In various exemplary embodiments, the embodiments of FIGS. 6 and 7 may be used in conjunction with the vortex mixer 100 described above to provide a technique for emulsion formation (e.g., bead emulsion formation) that may be automated and produce consistent and/or predictable emulsion formation.

With reference to FIG. 6, an exemplary embodiment of a system useful for emulsion preparation, such as, for example, bead emulsion preparation, is depicted. The embodiment comprises a mixing tube 50 (e.g., test tube) that defines a reservoir 55. The reservoir 55 is configured to contain a continuous emulsion phase, which in various exemplary embodiments may be light mineral oil with one or more oil-soluble surfactants (emulsion stabilizers). In general, higher viscosity oils (e.g., so called "heavy" mineral oil) are not a good choice for creating an uniform water-in-oil emulsion. According to various exemplary embodiments, the reservoir 55 may have a volume ranging from 5 to 100 millilters, for example, the reservoir 55 may have a volume of about 50 milliliters. In various embodiments, using different tubes for agitation (for example, 5 mL, 15 mL, 50 mL, etc.) allows for different volumes of oil and aqueous phase to be used. In certain embodiments, given the vortex that is generated, it may be anticipated that approximately ½ of the tube that is used is filled with the solution. For example, if a 50 mL conical is used, a volume of 25 mL may be used to accommodate the vortex.

The mixing tube 50 may define an opening at one end portion thereof (e.g., the top end portion in the orientation shown in FIG. 6) and a closed end portion 58 opposite the opening (e.g., the bottom end portion in the orientation shown in FIG. 6). In various exemplary embodiments, the configuration of the closed end portion of a mixing tube 50 may be such that it substantially mates with openings in a base plate of a vortex mixer so as to allow the mixing tube to substantially freely pivot about the closed end portion during orbital motion of the base plate. By way of nonlimiting example, the closed end portion 58 of the mixing tube 50 may taper inwardly in a direction toward the bottom of the mixing tube 50. As shown in FIG. 6, the closed end portion 58 may be substantially conically-shaped and configured to substantially mate with the tapered opening 122 of the base plate 120 of the exemplary embodiments of FIGS. 1-3 to facilitate the tube 50 to freely pivot about the closed end portion 58 (e.g., substantially freely rotate about the opening 122) during vortexing.

The system of FIG. 6 also includes a cap 60 configured to engage with a top end portion of the mixing tube 50 to close the opening of the mixing tube 50. The cap 60 may be made of plastic and configured to be removably mounted on the tube using screw-on or twist-lock engagements or any other known methods of engagement providing a tight seal between the tube and the cap.

The cap 60 may be configured to permit the passage of a dispensing tube 65 that is held in place via a fitting 68 disposed externally to the cap 60. The dispensing tube 65 may be open at both ends and hollow so as to be placed in flow communication with a supply of a substance and to deliver that substance into the reservoir 55 of the mixing tube 50. In various exemplary embodiments, the dispensing tube 65 may be made of stainless steel, PEEK or other known plastics compatible with DNA, PCR reagents, DNA beads and oil phase.

The dispensing tube 65 may be fixedly mounted to the cap 60, and the end of the dispensing tube 65 that supplies a substance to the reservoir 55 may be disposed at a distance ranging from about 1 mm to 15 mm, preferably 2 mm to 10 mm, from the bottom of the mixing tube 50. In an alternative embodiment, the dispensing tube 65 may be movable relative to the mixing tube 50 so that the distance of the end of the dispensing tube 65 that supplies substance to the mixing tube 50 to the bottom of the mixing tube 50 may be adjusted. In various embodiments the end of the tube 65 is immersed into the oil phase while dispensing the aqueous phase. Depending on the emulsification scale, one skilled in art may adjust the position of the tube 65 so that its end will be within the 1 to 15 mm from the bottom of the tube 50.

According to various exemplary embodiments, the dispending tube 65 may have a substantially circular cross-sectional configuration with a diameter ranging from about 0.3 to 1.0 mm, preferably 0.4 to 0.6 mm, most preferably 0.4 mm. The diameter of the dispensing tube 65 may be selected to permit dispensing of an aqueous emulsion phase (e.g., dispersion phase) comprising beads containing template, as has been described above. Dispensing tube 65 diameter may be selected based on anticipated dispense rate, desirable droplet size and related pressure buildup during dispensing. The higher dispense rate, the larger tube 65 diameter needs to be to allow aqueous phase to flow. On the other hand, if the diameter of the dispensing tube 65 is too large, it may result in formation larger than anticipated droplets. In various preferred exemplary embodiments, the dispensing tube diameter was 0.4 mm. As will be appreciated by one of skill in the art, based on the relationship between tube circumference, rpm and solution volume, one may empirically evaluate and/or calculate the effect that the diameter of the dispensing tube has on the forming of the emulsion and the appropriate diameter to optimize emulsion formation for a particular application.

In various exemplary embodiments, the dispensing tube 65 may be configured to be placed in flow communication with a supply of a substance, such as, for example, an aqueous phase (e.g., dispersion phase) of an emulsion, to be dispensed into the reservoir 55 of the mixing tube 50. As illustrated in the exemplary embodiments of FIGS. 2 and 7, the dispensing tube 65 may be placed in flow communication with a syringe 80 via the fitting 68.

Thus, the exemplary system of FIG. 6 may be readily placed in and out of flow communication with one or more supplies of a substance, for example, to introduce differing desired substances into the mixing tube 50. For example, as depicted in the exemplary embodiment of FIG. 2, the dispensing tubes 65 of the mixing tubes 50 may be placed in respective flow communication with each of the syringes 80 held by the syringe pump 150.

The dispensing tube 65 may be used to deliver an aqueous phase from a syringe 80 with which it is placed in flow communication and into the mixing tube reservoir 55, which may, in various exemplary embodiments, be filled with an oil. In various exemplary embodiments, the dispensing tube 65 may be placed in flow communication with a supply of an aqueous phase comprising microreactor beads carrying nucleic acid template. The supply of the aqueous phase also may contain a reagent and/or other constituents configured to support a biological reaction, such as, for example, PCR, for introducing with the beads into reservoir 55.

Figure 8:
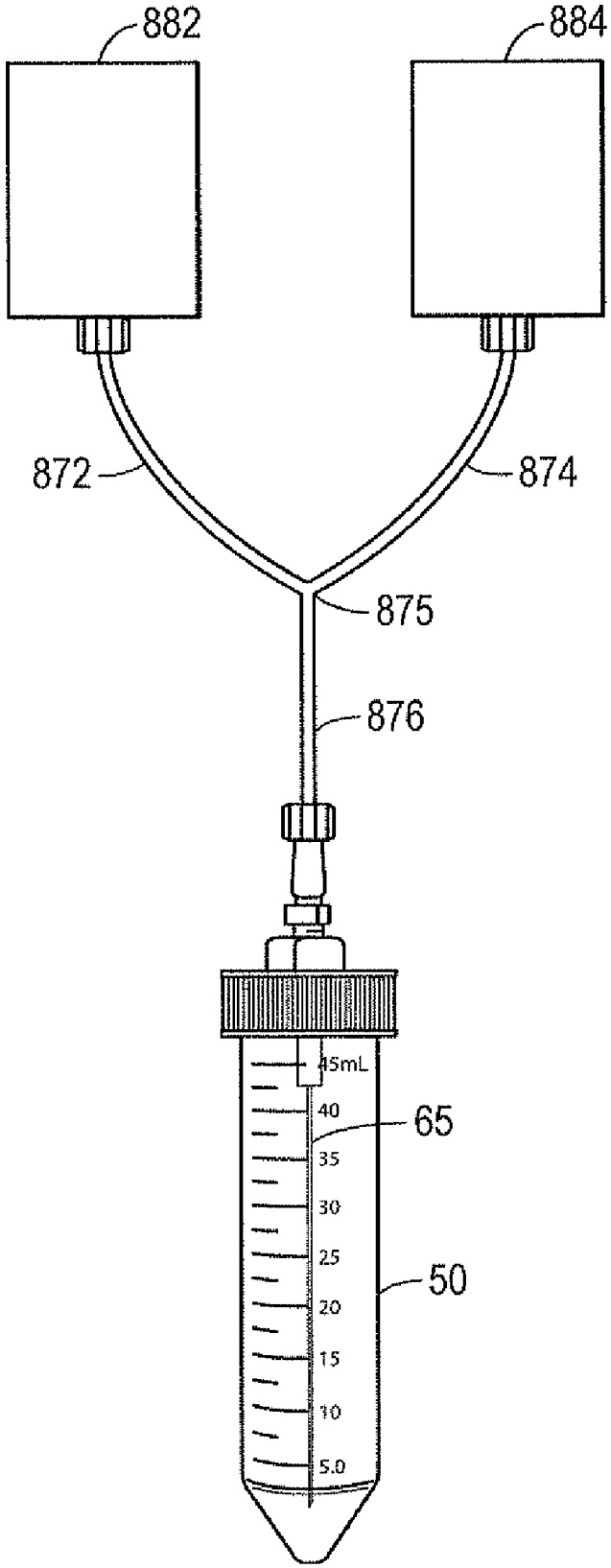
FIG. 8 is a schematic perspective view of another exemplary embodiment of an emulsion preparation system according to aspects of the present teachings.

In various exemplary embodiments, one or more separate supplies of an aqueous phase may be placed in flow communication with the dispensing tube 65. For example, as schematically represented in the exemplary embodiment of FIG. 8, a supply 882 of reagent and a separate supply 884 of microreactor beads, may be supplied and mixed into a common feed tube 875 that ultimately is placed in flow communication with the dispensing tube 65 to deliver the aqueous phase mixture to the mixing tube 50. The common feed tube 875 may have a Y-junction at an upper portion thereof with each branch 872 and 874 of the Y respectively connecting to a separate supply 882 and 884, and the end portion 876 of the Y connecting ultimately to the dispensing tube 65, as shown in FIG. 8, or to a syringe (not shown) that is ultimately connected to the dispensing tube 65. In yet various other exemplary embodiments, the dispensing tube 65 may be in the form of concentric dispensing tubes each connected to a different supply of an aqueous phase According to various exemplary embodiments, the components of the system shown in FIGS. 6 and 7 may be disposable and configured to be thrown away after use for forming an emulsion. Alternatively, the various components may be configured to be reused more than once.

Those having ordinary skill in the art would recognize a variety of ways to place the dispensing tube 65 in flow communication with one or more supplies of one or more aqueous phases (e.g., dispersion phases) to dispense such phases into the mixing tube reservoir 55. Although many exemplary embodiments described herein utilize a syringe as the supply of substance in flow communication with the dispensing tube, it should be understood that various other supply mechanisms may be used, such as, for example, a reservoir with a positive displacement pump to supply fluid into the dispensing tube.

In accordance with various exemplary embodiments, a method for forming an emulsion, such as, for example, a bead emulsion as described above, may include placing one or more mixing tubes 50 filled with oil to less than ½ of its capacity, preferably to less than ⅓ of its capacity and most preferably to between ¼ to ⅙ of its capacity. For a non-limiting example, in a preferred embodiment, a 9-ml aliquot of the continuous oil phase is placed into a 50-ml mixing tube 50. Oil phase may be introduced into the mixing tube by dispensing using a serological pipette, a syringe or any other known measuring device. Oil phase can also be poured from a pre-measured container or may be pumped in using a peristaltic pump or any other means. It will be appreciated that the actual oil amount may depend on the selected tube/application. The emulsion may be formed, such as, for example, a bead emulsion as described above, by placing one or more mixing tubes 50 filled with oil in position in the vortex mixer 100, as shown in FIG. 2, for example, with the closed end portion of the tube 50 being received in an opening 122 of a base plate 120 and the upper end portion of the tube 50 being supported by the support member 130. The dispensing tube 65 may be placed in flow communication with a respective syringe 80 held by the syringe pump 150 and connection tubing 75. An aqueous phase containing beads carrying nucleic acid template and/or one or more reagents and other constituents may be contained in the syringe 80.

The vortex mixer 100 may be turned on to provide an orbital movement to the base plate 120 via the motors, which in turn can impart a substantially orbital movement to the closed end portion of the mixing tube 50. The speed of the base plate movement may be adjusted, either programmably or manually, until vortexes are formed in the oil contained in the mixing tube reservoir 55. After vortexes are formed in the oil, the syringe pump 150 may be activated, for example, via a programmed protocol or manually, to depress the syringe plunger 85 at a controlled rate. An aqueous dispersion phase may thus be displaced from the syringe reservoir 86 at a predetermined and controlled rate based on the rate of the syringe pump 150. In accordance with various exemplary embodiments, the rate at which the syringe pump 150 bears down on the syringe piston 85 may range from about 0.1 to about 1.5 ml/min. Addition of aqueous phase to the oil phase can continue until the desired bead emulsion is formed.

In accordance with exemplary embodiments of the present teachings, the vortex mixer 100 may be configured such that the vortexing rate is substantially constant, irrespective of such factors as the amount of substance contained in the mixing tubes 50, the addition of the aqueous phase to the continuous oil phase, and/or the clamping force exerted on the tubes by the clamping plates 138, for example. The ability to maintain a predictable and substantially constant vortexing rate provides a technique that facilitates consistent emulsion formation.

In one exemplary embodiment, oil phase is prepared by dissolution of approximately 7.5% volume/volume SPAN80 and 0.4% volume/volume Tween80 in light mineral oil. Then a dispensing tube 50 is filled with approximately 9 ml oil phase, a cap 60 with mounted dispense tube 65 is screwed-in, and the tube 50 is placed in the vortex mixer 100. PCR reagent mixture is mixed with the approximately 1-μm beads, then aspirated into a syringe installed in the syringe pump 150. The syringe is connected to the dispensing tube 65 via adapter 72. Vortex mixer 100 is turned on and set at approximately 2000 rpm for approximately 9 min 53 sec. Total volume of the PCR mix (2.8 ml) is dispensed into oil after the vortex mixer 100 is stabilized at the set speed. Dispense rate is approximately 0.8 ml/min. Total dispense time is about 4.5 min. After dispensing is finished, the emulsion is vortexed for about 5 more minutes at the set speed until the preset time elapsed. In the described embodiment, about 1.7 Billion beads are emulsified in a single mixing tube 50. Droplet size is in the range of approximately 4 to 7 μm (33-180 fl volume). These reactors (droplets) provide sufficient amount of PCR reagents to amplify a single template molecule if it is present in the droplet.

Although FIGS. 1 and 2 depict a vortex mixer 100 having two operating platforms (i.e., two base plates, two motors, two support plates, etc.), it should be understood that vortex mixers in accordance with the present teachings may have a single operating platform or more than two operating platforms. Those having skill in the art would understand how to achieve such modifications as desired. Moreover, although various embodiments shown and described include base plates and corresponding support members configured to receive up to three mixing tubes, those having skill in the art would understand that the base plates and support members could be configured to hold any number of mixing tubes simultaneously.

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges subsumed therein. For example, a range of "less than 10" includes any and all subranges between (and including) the minimum value of zero and the maximum value of 10, that is, any and all subranges having a minimum value of equal to or greater than zero and a maximum value of equal to or less than 10, e.g., 1 to 5.

It is noted that, as used in this specification and the appended claims, the singular forms "a," "an," and "the," include plural referents unless expressly and unequivocally limited to one referent. As used herein, the term "include" and its grammatical variants are intended to be non-limiting, such that recitation of items in a list is not to the exclusion of other like items that can be substituted or added to the listed items.

It will be apparent to those skilled in the art that various modifications and variations can be made to the devices, systems, and methods of the present disclosure without departing from the scope its teachings. Other embodiments of the disclosure will be apparent to those skilled in the art from consideration of the specification and practice of the teachings disclosed herein. It is intended that the specification and examples be considered exemplary only.

What is claimed is:

1. A vortex mixer comprising:

at least one base plate defining at least one first opening configured to receive a first closed end portion of at least one mixing tube and to permit the at least one mixing tube to pivot about the first closed end thereof;

at least one motor configured to impart a substantially orbital movement to the base plate; and at least one support member disposed at a distance from the at least one base plate, the at least one support member being configured to receive a second end portion of the at least one mixing tube and to permit the at least one mixing tube to substantially freely pivot about the first closed end portion during orbital movement of the at least one base plate.

2. The vortex mixer of claim 1, wherein the at least one first opening comprises a plurality of first openings.

3. The vortex mixer of claim 1, wherein the at least one support member defines at least one second opening configured to receive the second end portion of the at least one mixing tube.

4. The vortex mixer of claim 1, wherein the at least one support member is configured to receive second end portions of a plurality of mixing tubes simultaneously.

5. The vortex mixer of claim 1, wherein the at least one support member defines a plurality of openings each configured to receive a respective second end portion of each of a plurality of mixing tubes.

6. The vortex mixer of claim 1, wherein the at least one support member comprises rubber.

7. The vortex mixer of claim 1, wherein the at least one base plate comprises a plurality of base plates and the at least one support member comprises a plurality of support members.

8. The vortex mixer of claim 7, wherein the plurality of base plates comprise two base plates and the plurality of support members comprise two support members.

9. The vortex mixer of claim 1, wherein the distance between the at least one support member and the at least one base plate is adjustable.

10. The vortex mixer of claim 1, wherein the at least one support member is movable relative to the at least one base plate so as to adjust the distance between the at least one support member and the at least one base plate.

11. The vortex mixer of claim 10, wherein the at least one support member is movable along posts.

12. The vortex mixer of claim 1, further comprising a syringe pumping mechanism configured to hold at least one syringe.

13. The vortex mixer of claim 12, wherein the syringe pumping mechanism is configured to hold a plurality of syringes.

14. The vortex mixer of claim 12, wherein the syringe pumping mechanism is programmable.

15. The vortex mixer of claim 1, wherein the at least one first opening is tapered.

16. The vortex mixer of claim 1, wherein the at least one first opening is substantially conically-shaped.

17. The vortex mixer of claim 1, wherein the at least one first opening comprises an edge portion defining a radius.

18. A system for forming an emulsion, the system comprising:

a mixing tube defining a reservoir configured to contain a continuous emulsion phase, the mixing tube defining an open end portion;

a cap configured to engage with the open end portion of the mixing tube; and a dispensing tube having a first end positioned within the reservoir and a second end configured to be placed in flow communication with a supply of an aqueous phase, the dispensing tube being configured to flow the aqueous phase from the supply to the reservoir.

19. The system of claim 18, wherein the mixing tube has a closed end portion disposed substantially opposite the open end portion.

20. The system of claim 18, wherein the closed end portion is configured to be received by a base plate of a vortex mixer.

21. The system of claim 18, wherein the cap is configured to permit the dispensing tube to pass therethrough.

22. The system of claim 18, wherein the dispensing tube is configured to be movable relative to the mixing tube so as to adjust a depth of the first end of the dispensing tube in the reservoir.

23. The system of claim 18, wherein the mixing tube has a closed end portion substantially opposite the open end portion and the dispensing tube is fixedly mounted such that the first end is positioned at a selected distance from the closed end portion ranging.

24. The system of claim 18, wherein the dispensing tube comprises stainless steel.

25. The system of claim 18, wherein the dispensing tube is configured to flow an aqueous phase comprising beads containing a biological sample.

26. The system of claim 25, wherein the dispensing tube is configured to flow an aqueous phase comprising beads of a dimension ranging from approximately 0.1 to 100 um.

27. The system of claim 25, wherein the dispensing tube is configured to flow an aqueous phase comprising beads of a dimension ranging from approximately 0.5 to 5 um.

28. The system of claim 25, wherein the dispensing tube is configured to flow an aqueous phase comprising beads of a dimension ranging from approximately 0.5 to 3 um.

29. The system of claim 25, wherein the dispensing tube is configured to flow an aqueous phase comprising at least one reagent and beads containing nucleic acid templates.

30. The system of claim 18, wherein the mixing tube comprises a substantially conically shaped closed end portion opposite the open end portion.

31. The system of claim 18, further comprising a fitting on the second end of the dispensing tube, the fitting being configured to connect to a flow tube in flow communication with a syringe.

32. The system of claim 31, wherein the fitting comprises a luer fitting.

33. A method of forming a bead emulsion for amplifying nucleic acid, the method comprising:

supplying a mixing tube with a continuous emulsion phase;

imparting motion to the mixing tube via a vortex mixer so as to form vortexes in the continuous emulsion phase; and dispensing an aqueous phase comprising beads containing nucleic acid into the mixing tube while imparting the motion to the mixing tube.

34. The method of claim 33, wherein the dispensing occurs via a dispensing tube in flow communication with a supply of the aqueous phase.

35. The method of claim 34, further comprising supplying the aqueous phase to the dispensing tube from at least one syringe containing the aqueous phase.

36. The method of claim 35, further comprising pumping the aqueous phase from the syringe via an automated syringe pumping mechanism.

37. The method of claim 33, wherein the imparting motion comprises imparting an orbital motion to the mixing tube.

38. The method of claim 37, wherein the imparting the orbital motion comprises imparting an orbital motion to a closed end of the mixing tube.

39. The method of claim 33, wherein the dispensing the aqueous phase comprises modulating a rate of the dispensing.

40. The method of claim 33, wherein the imparting the motion and the dispensing are automated.

41. The method of claim 33, further comprising supporting the mixing tube via the vortex mixer during the imparting the motion.

42. The method of claim 41, wherein supporting the mixing tube via the vortex mixer comprises supporting the mixing tube via the vortex mixer without a user handling the mixing tube.

43. The method of claim 41, wherein the supporting the mixing tube via the vortex mixer comprises supporting a closed end portion of the mixing tube via a base plate of the vortex mixer and supporting a second end portion opposite the closed end portion via a support member of the vortex mixer.

44. The method of claim 41, wherein the imparting the motion comprises modulating a speed of the motion of the mixing tube.

45. The method of claim 41, further comprising forming an emulsion comprising light mineral oil with stabilizers as continuous phase and PCR reagent mixture with 1 um paramagnetic beads as disperse phase.

46. The method of claim 45 wherein said emulsion has an approximate droplet size of 4 to 7 um with approximately 1 bead per 10 droplets of the desired size on average.

47. The method of claim 33, wherein the dispensing comprises dispensing the aqueous phase from an end of the dispensing tube positioned within the vortexes formed in the continuous phase.

48. The method of claim 33, wherein the supplying the mixing tube with a continuous emulsion phase comprises supplying the mixing tube with oil.

49. The method of claim 33, wherein dispensing the aqueous phase comprising beads containing nucleic acid into the mixing tube comprises dispensing an aqueous phase comprising at least one reagent for supporting an amplification reaction and beads containing nucleic acid.

* * * * *